US005552871A

United States Patent [19]

Kutsuwada et al.

[11] Patent Number: 5,552,871

[45] Date of Patent: Sep. 3, 1996

[54] IMAGE TRANSFERRING DEVICE FOR IMAGE FORMING APPARATUS

[75] Inventors: Akio Kutsuwada, Kanagawa-ken; Masakuni Konja, Souka, both of Japan

[73] Assignee: Ricoh Company, Ltd., Tokyo, Japan

[21] Appl. No.: 498,782

[22] Filed: Jul. 5, 1995

Related U.S. Application Data

[63] Continuation of Ser. No. 242,882, May 16, 1994, Pat. No. 5,493,371.

[30] Foreign Application Priority Data

Jun. 11, 1993 [JP] Japan ..... 5-140468

[51] Int. Cl.[6] ..... G03G 15/14

[52] U.S. Cl. ..... 355/271; 355/273

[58] Field of Search ..... 355/271, 274, 355/275, 273, 277

[56] References Cited

U.S. PATENT DOCUMENTS

| | | | |
|---|---|---|---|
| 5,198,863 | 3/1993 | Goto et al. | 355/274 |
| 5,386,274 | 1/1995 | Sanpe et al. | 355/274 X |
| 5,461,461 | 10/1995 | Harasawa et al. | 355/274 |
| 5,469,248 | 11/1995 | Fujiwara et al. | 355/271 X |
| 5,495,317 | 2/1996 | Matsuda et al. | 355/274 X |

FOREIGN PATENT DOCUMENTS 3-231274 10/1991 Japan .

*Primary Examiner*—Arthur T. Grimley
*Assistant Examiner*—Shuk Yin Lee
*Attorney, Agent, or Firm*—Oblon, Spivak, McClelland, Maier & Neustadt, P.C.

[57] ABSTRACT

A device incorporated in an image forming apparatus for transferring an image from a photosensitive element to a transfer sheet. The transfer device includes a drive roller, a driven roller, a transfer belt for transferring a toner image formed on a latent image carrier to a transfer sheet, a bias roller, a feedback roller. In addition a power source device is provided for applying a voltage to the bias roller from a power source, and includes a control for controlling an output of the power source. The transfer belt passes over the drive roller and the driven roller, and the power source is connected to the bias roller and the feedback roller. Where an output current flowing from the power source to the transfer belt via the bias roller is I-1, and a feedback current flowing from the transfer belt to the power source via the feedback roller is I-2, the currents are controlled such that they satisfy the following equation:

$$I\text{-}1-I\text{-}2=K$$

where K is constant. The feedback roller is located upstream of the driven roller with respect to the moving direction of the transfer belt and is located between the bias roller and the driven roller in the horizontal direction.

4 Claims, 5 Drawing Sheets

IMAGE TRANSFERRING DEVICE FOR IMAGE FORMING APPARATUS

This is a Continuation, of application Ser. No. 08/242,882 filed on May 16, 1994, now U.S. Pat. No. 5,493,371.

BACKGROUND OF THE INVENTION

1. Field of the Invention:

The present invention relates to an image transferring device for an image forming apparatus such as a copier, printer, facsimile transceiver or similar photographic image forming apparatus in which an image is electrostatically formed on an image carrier. More particularly, the invention is concerned with an image transferring device for transferring an image from the image carrier to a transfer belt while transporting a transfer sheet and while the transfer sheet is electrostatically adhered to the transfer belt.

2. Description of the Related Art:

Japanese Patent Laid-Open Publication No. 3-167579 discloses a conventional image transferring device for an image forming apparatus, with the transfer belt device provided for an image forming apparatus such as a copier, or a printer.

Referring to FIG. 8, with such a transfer belt device for the image forming apparatus, a transfer belt 1 is disposed below a photosensitive drum 7 and passes over a conductive drive roller 2 and a conductive driven roller 3. The conductive drive roller 2 is connected to a motor, not shown, and is rotated in a direction indicated by an arrow in the figure. As the conductive drive roller 2 is rotated, the transfer belt 1 is moved in a direction for transferring a transfer sheet 6 (indicated by the arrow in the figure).

A bias roller 4 is located downstream of the conductive driven roller 3 with respect to the moving direction of the transfer belt 1. The bias roller 4 is held in contact with an inner surface of the transfer belt 1. A power source 5 is connected to the bias roller 4 and applies to the transfer belt 1 a charge which is opposite in polarity to that of the toner deposited on the photosensitive drum 7. The conductive drive roller 2 is connected to ground so as to allow a flow of electric current from the transfer belt 1 to ground. The electric current is fed to the transfer belt 1 via the bias roller 4 from the power source 5. An eraser, not shown, is disposed near the conductive driven roller 3 so as to remove the charge from the transfer belt 1 by irradiation.

The transfer sheet 6 is delivered from a paper feeding device, not shown. The transfer sheet 6 is polarized by charging, in which the charge is applied from the bias roller 4 via the transfer belt 1.

An electrostatic charge is generated on the basis of the relation between a net charge on the transfer belt 1 and a polarized charge on the transfer sheet 6. The transfer sheet 6 is thus adhered onto the transfer belt 1 by the electrostatic charge. A toner image is transferred from the photosensitive drum 7 to the transfer sheet 6, and the transfer sheet 6 on which the toner image is formed is delivered by the transfer belt 1. The transfer sheet 6 is then separated from the transfer belt 1 at the location of the conductive drive roller 2 by the rigidity of the transfer sheet 6, which is also known as a curvature separation (i.e., as the sheet passes over the curvature of the roller).

However, in the above-described conventional transfer belt device, when the power source 5 supplies the electric current to the transfer belt 1 via the bias roller 4, a surface potential of the conductive driven roller 3 is substantially equal to a surface potential of the bias roller 4. The photosensitive drum 7 is held in contact with the transfer belt 1 to form a nip portion 8, and the toner image is normally transferred from the photosensitive drum 7 to the transfer sheet 6 at the nip portion 8. However, in this condition, the toner image is transferred from the photosensitive drum 7 to the transfer sheet 6 upstream of the nip portion 8 with respect to the moving direction of the transfer belt 1, which is called a pre-transfer.

As a result of the pre-transferring of toner, the toner image of the photosensitive drum 7 is not transferred to a correct position of the transfer sheet 6 and thus the quality of an image on the transfer sheet 6 is degraded.

In addition, dust can be transferred to the transfer sheet 6 under the condition of the pre-transfer, thereby further degrading the quality of an image on the transfer sheet 6.

Further, the conductive drive roller 2 has a rubber surface so as to prevent slippage between the transfer belt 1 and the conductive drive roller 2, with the rubber of the conductive drive roller 2 formed of a conductive material. However the cost of the rubber made of a conductive material is expensive, and thus the production cost of the above-mentioned transfer belt device is increased.

SUMMARY OF THE INVENTION

Accordingly, the present invention provides an image transferring device for an image forming apparatus which can solve the aforementioned conventional drawbacks, and, thus, an object of the present invention is to provide an image transferring device for an image forming apparatus which prevents or reduces the transfer of the toner image from the photosensitive drum to the transfer sheet upstream of the nip portion with respect to the moving direction of the transfer belt so as to prevent the pre-transferring of toner.

It is another object of the present invention to provide an image transferring device for an image forming apparatus which can improve the quality of the image formed on the transfer sheet.

It is another object of the present invention to provide an image transferring device for an image forming apparatus which can reduce the production cost of the transfer belt device for the image forming apparatus.

In order to achieve the above-mentioned objects, according to the present invention, an image transferring device is provided for an image forming apparatus which includes a drive roller, a driven roller, a transfer belt for transferring a toner image formed on a latent image carrier to a transfer sheet, a bias roller, a feedback roller, and a power source device for applying a voltage to the bias roller from a power source, and for controlling an output of the power source.

The transfer belt passes over the drive roller and the driven roller, and the power source means is connected to the bias roller and the feedback roller.

Where an output current flowing from the power source to the transfer belt via the bias roller is I-1, and a feedback current flowing from the transfer belt to the power source means via the feedback roller is I-2, with a preferred form of the present invention, I-1 and I-2 satisfy the following equation:

$$I\text{-}1-I\text{-}2=K$$

where K is constant. In addition, the feedback roller is located upstream of the driven roller with respect to the moving direction of the transfer belt and is located between the bias roller and the driven roller at a predetermined interval. More particularly, as will become apparent herein, at least one feedback roller is disposed between the driven roller and the bias roller with respect to a horizontal direction. Other objects and aspects of the present invention will become apparent herein.

BRIEF DESCRIPTION OF THE DRAWINGS

The above and other objects, features and advantages of the present invention will become apparent from the following detailed description, particularly when considered in conjunction with the accompanying drawings in which.

DESCRIPTION OF THE PREFERRED EMBODIMENTS

Preferred embodiments of an image transferring device for an image forming apparatus in accordance with the present invention will now be explained with reference to the accompanying drawings, wherein like numerals are utilized to designate identical or corresponding elements throughout the several views.

Figure 1:
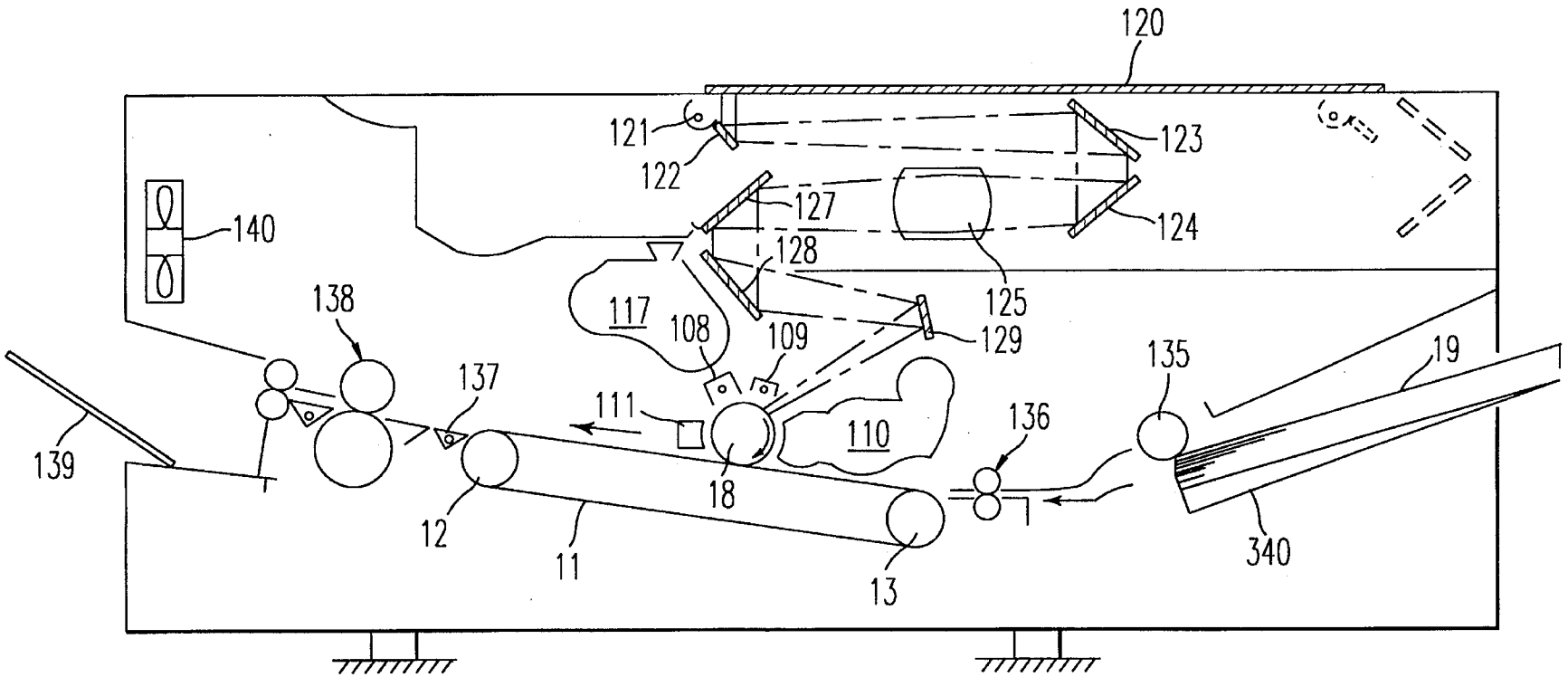
FIG. 1 is a schematic sectional view of one embodiment of a copier in accordance with the present invention.

FIG. 1 is a schematic side sectional view of one embodiment of a copier in accordance with the present invention. Referring to FIG. 1, the copier includes a photosensitive drum 18 which is rotatably supported by a housing of the copier. The photosensitive drum 18 is driven to rotate in the direction indicated by an arrow at constant speed.

An endless transfer belt 11 extends around a conductive drive roller 12 and a conductive driven roller 13. The transfer belt 11 is driven to travel in the direction indicated by an arrow, with an outer surface of the transfer belt 11 in rolling contact with the photosensitive drum 18.

Around the photosensitive drum 18 and along the direction of rotation thereof is disposed a primary charger 108, a secondary charger 109, a developing unit 110 for developing a latent image with toner, the transfer belt 11, and a cleaning unit 112. In addition, an image exposure position for applying a light image from an original to the photosensitive drum 18 is defined between the secondary charger 109 and the developing unit 110.

The present copier also includes a contact glass 120 which serves as an original holder for holding thereon an original to be copied. Below the contact glass 120, an illumination lamp 121 for illuminating an original placed on the contact glass 120 is disposed. Reflecting mirror 122 is provided integrally with the illuminating lamp 121. Another pair of reflecting mirrors 123 and 124 are also provided below the contact glass 120 to change the direction of the light image reflected from the reflecting mirror 122. The illumination lamp 121 and the reflecting mirrors 122, 123 and 124 move along the contact glass 120 to carry out slit scanning for the original placed on the contact glass 120. A focusing lens 125 is also provided for receiving light reflecting from the reflecting mirror 124. Thus, an optical path is provided for forming the latent image of the photoconductive drum, with the optical path indicated by the broken line.

Still referring to FIG. 1, the sheet feeding and image transferring will now be described. As shown in FIG. 1, a stack of a transfer sheets 19 is placed on a supply table 340. A feed roller 135 is provided at the supply end of the supply table 340 in contact with the topmost transfer sheet 19 of the stack. When the feed roller 135 is intermittently driven to rotate in synchronism with the progress of a copying operation, the transfer sheets 19 are supplied one by one and then transported by transport rollers 136 onto the transfer belt 11. The transfer sheet 19 comes into contact with the photosensitive drum 18 whereby a toner image is transferred from the photosensitive drum 18 to the transfer sheet 19.

A separating pawl 137 is disposed at the end of a forward travel of the transfer belt 11, so that the transfer sheet 19 is separated from the transfer belt 11. The transfer sheet 19 then proceeds toward an image fixing unit 138 where the toner image is fixed upon the transfer sheet 19. The transfer sheet 19 is then discharged onto a tray 139. A ventilation fan 140 for ventilating the air inside the copier is provided.

Preferred embodiments of the present invention will now be described in detail. The embodiments which follow are provided as examples, as other embodiments are possible. Different embodiments may perform better under different conditions, for example based upon the selection of different materials for the various elements. In addition, the selection of a predetermined spacing among the respective elements may vary based upon, e.g., the overall size of the apparatus and the composition of the various elements.

First Embodiment

Figure 2:
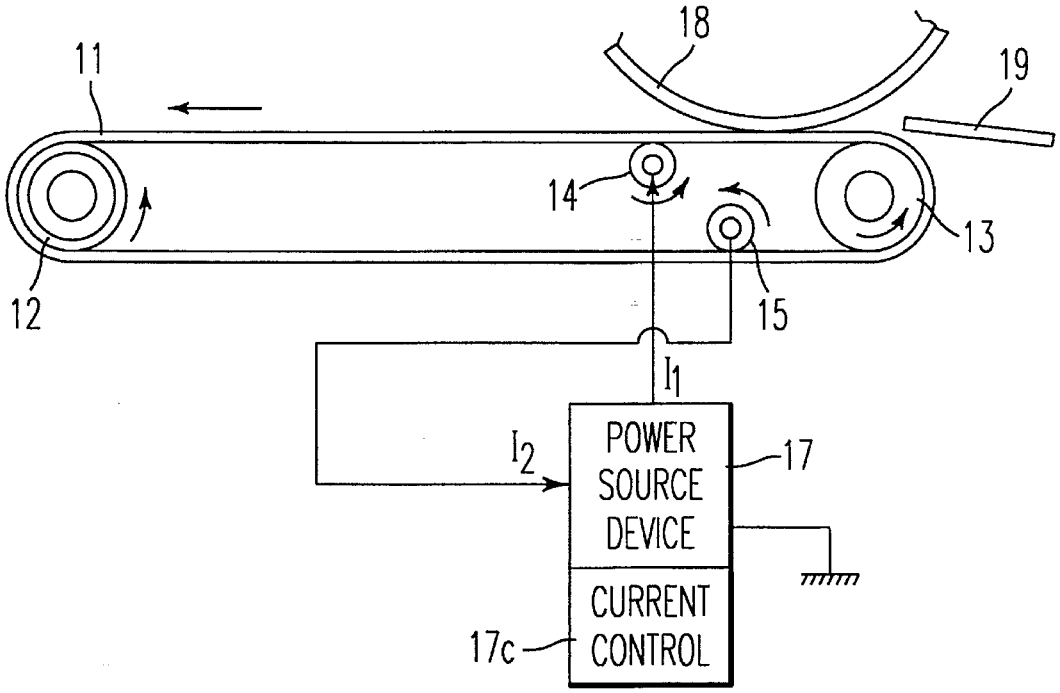
FIG. 2 is a side view showing the construction of a first embodiment of an image transferring device for an image forming apparatus in accordance with the present invention.

FIG. 2 is a side section illustrating the construction of a first embodiment of an image transferring device for an image forming apparatus in accordance with the present invention, which can be used, for example, in a copier or printer.

The image transferring device has a transfer belt a drive roller 12, a conductive driven roller 13, a bias roller 14, a feedback roller 15, and a power source 17.

The transfer belt 11 is made of rubber with a medium electrical resistance (outer surface $6\times10^{11}$ Ω-cm, inner surface $3\times10_{7}$ Ω-cm). The transfer belt 11 is disposed below a photosensitive drum 18 and passes over the drive roller 12 and the conductive driven roller 13.

The drive roller 12 has a metallic core and a layer covering the metallic core is made of a non-conductive rubber. The conductive driven roller 13 is made of metal. The drive roller 12 is connected to a motor, not shown, and is rotated around an axis in a direction indicated by an arrow in the figure. As the drive roller 12 is rotated, the transfer belt 11 is moved in a direction for transferring a transfer sheet 19 (indicated by the arrow in the figure). Further, as the drive roller 12 is rotated, the conductive driven roller 13 is also rotated around an axis in the direction indicated by the arrow in the figure.

The bias roller 14 is made of metal and is located downstream of the conductive driven roller 13 with respect to the moving direction of the transfer belt 11, with the bias roller 14 held in contact with an inner surface of the transfer belt 11. As the transfer belt 11 is moved in a direction for transferring the transfer sheet 19, the bias roller 14 is rotated around an axis in the direction indicated by the arrow in the figure.

The feedback roller 15 is made of metal and functions as a transfer current feedback member. The feedback roller 15 is located upstream of the conductive driven roller 13 with respect to the moving direction of the transfer belt 11, and is located between the bias roller 14 and the conductive driven roller 13 at a predetermined interval. More particularly, as shown in FIG. 2, the feedback roller 15 is located close to the driven roller 13, such that with respect to the horizontal direction, the feedback roller is between the bias roller 14 and the driven roller 13. The feedback roller 15 is held in contact with the inner surface of the transfer belt 11.

As the transfer belt 11 is moved in a direction for transferring the transfer sheet 19, the feedback roller 15 is rotated around an axis in the direction indicated by the arrow in the figure. The photosensitive drum 18, which is a drum-shaped latent image carrier, is uniformly charged by the charger (as discussed earlier with reference to FIG. 1). An image exposure is then applied to the photosensitive drum 18 by an exposure device.

An electrostatic latent image is formed on the photosensitive drum 18. The electrostatic latent image is developed as a toner image by the developing unit, and the toner image is fed to a transferring position, which is a nip portion between the belt and drum. The photosensitive drum 18 is held in contact with the transfer belt 11 at the transferring position.

The conductive drive roller 12 is driven by a rotational force of a drive device, not shown, in the direction indicated by the arrow in the figure. An outer surface of the drive roller 12 is held in contact with the inner surface of the transfer belt 11. Both the outer surface of the conductive drive roller 12 and the inner surface of the transfer belt 11 are made of rubber. The frictional coefficient of rubber is high so as to prevent slippage between the transfer belt 11 and the drive roller 12, such that a rotational force of the drive roller 12 is transmitted to the transfer belt 11. The transfer belt 11 is thus moved in the direction indicated by the arrow in the figure, with the conductive driven roller 13 rotated by the movement of the transfer belt 11.

A power source device 17 is connected to the bias roller 14 and the feedback roller 15. The power source device 17 applies a voltage to the bias roller 14 from a power source and controls the output of the power source with a current control or circuit board current control.

Assume that an output current flowing from the power source to the transfer belt 11 via the bias roller 14 is I-1, and that a feedback current flowing from the transfer belt 11 to the power source device 17 via the feedback roller 15 is I-2. The output current from the power source is controlled so as to satisfy a following equation:

$$I\text{-}1\text{-}I\text{-}2=K$$

where K is constant.

With this relationship, current flowing from the transfer belt 11 to the photosensitive drum 18 remains constant and the toner image can more reliably be transferred to the transfer sheet 19 under a stable transfer condition.

The current control board (represented at 17*c* in the drawings) of the power source device 17 has a subtractor device and a current control device. The subtractor subtracts the output current I-1 flowing from the power source to the transfer belt 11 via the bias roller 14 from the feedback current I-2 flowing from the transfer belt 11 to the power source device 17 via the feedback roller 15. The current control controls the output current I-1 flowing from the power source to the bias roller 14 such that K remains constant in the equation "I–1–I–2=K", which is obtained from the result calculated by the subtractor means.

The transfer sheet 19 is delivered from a paper feeding device, not shown in FIG. 2. The transfer sheet 19 is polarized by charging, in which a charge is applied from the bias roller 14 via the transfer belt 11. An electrostatic charge is generated on the basis of the relationship between the net charge on the transfer belt 11 and the polarized charge on the transfer sheet 19. In addition, the transfer sheet 19 is adhered onto the transfer belt 11 by the electrostatic charge. The toner image is thus transferred from the photosensitive drum 18 to the transfer sheet 19 at the nip portion between the photosensitive drum 18 and the transfer belt 11.

The transfer sheet 19 on which the toner image is formed is delivered by the transfer belt 11. While the transfer sheet 19 is being delivered, an amount of the charge on the transfer sheet 19 is gradually decreased by the transfer belt 11 having a medium (e.g., as discussed earlier, outer surface $6\times10^{11}$ Ω-cm, inner surface $3\times10^{7}$ Ω-cm) electrical resistance and the feedback roller 15. After a decrease in the amount of the charge on the transfer sheet 19, the transfer sheet 19 is weakly adhered onto the transfer belt 11 by the electrostatic charge. The transfer sheet 19 is then separated at the location of the drive roller 12 by the rigidity of the transfer sheet 19, which is also known as a curvature separation.

Since the feedback roller 15 is located upstream of the conductive driven roller 13 with respect to the moving direction of the transfer belt 11 and is located between (i.e., in the horizontal direction) the bias roller 14 and the conductive driven roller 13 at a predetermined interval, a surface potential of the transfer belt 11 at the location of the feedback roller 15 is substantially zero, and the surface potential of the transfer belt 11 at a location of the bias roller 14 is maximum.

A surface potential inclination of the transfer belt 11 is formed as described above, and the surface potential of the conductive driven roller 13 is lowered. As a result, with the image transferring device of the present invention, the toner image is not transferred from the photosensitive drum 18 to the transfer sheet 19 upstream of the nip portion with respect to the moving direction of the transfer, thus preventing pre-transferring of toner.

Accordingly, the image transferring device can improve the quality of the image on the transfer sheet 19. In addition, since the drive roller 12 has a layer which is made of a non-conductive rubber, the image transferring device can reduce the production cost of the transfer belt device (i.e., as compared with a conductive rubber discussed earlier).

Second Embodiment

Figure 3:
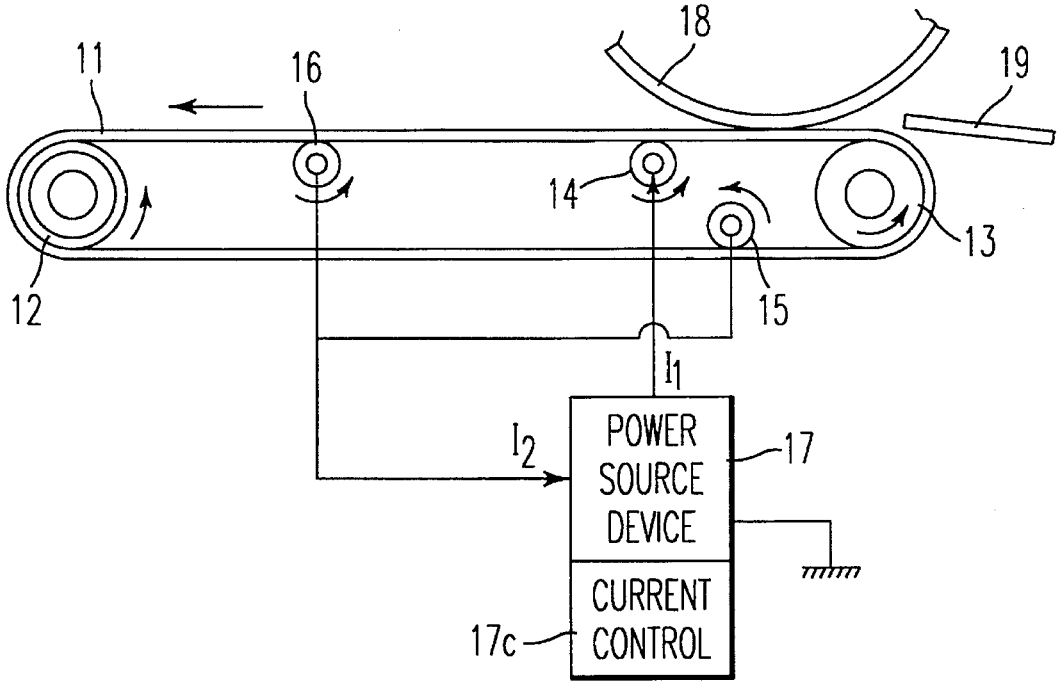
FIG. 3 is a side view showing the construction of a second embodiment of the image transferring device for the image forming apparatus in accordance with the present invention.

FIG. 3 is a side section showing the construction of a second embodiment of an image transferring device for an image forming apparatus in accordance with the present invention.

The image transferring device has a transfer belt a drive roller 12, a conductive driven roller 13, a bias roller 14, a first feedback roller 15, a second feedback roller 16 and a power source 17.

As in the first embodiment, the transfer belt 11 is made of rubber with a medium or moderate electrical resistance and is disposed below a photosensitive drum 18 while passing over the drive roller 12 and the conductive driven roller 13. The drive roller 12 has a metallic core and a layer covering the metallic core. The layer is made of a non-conductive rubber. The conductive driven roller 13 is made of metal. The drive roller 12 is connected to a motor, not shown, and is rotated around an axis in a direction indicated by an arrow in the figure. As the drive roller 12 is rotated, the transfer belt 11 is moved in a direction for transferring a transfer sheet 19 (indicated by the arrow in the figure). As the drive roller 12 is rotated, the conductive driven roller 13 is also rotated around an axis in the direction indicated by the arrow in the figure.

The bias roller 14 is made of metal and is located downstream of the conductive driven roller 13 with respect to the moving direction of the transfer belt 11. The bias roller 14 is also held in contact with an inner surface of the transfer belt 11. As the transfer belt 11 is moved in a direction for transporting the transfer sheet 19, the bias roller 14 is rotated about its axis in the direction indicated by the arrow in the figure.

The first feedback roller 15 is made of metal as a transfer current feedback member. The first feedback roller 15 is located upstream of the conductive driven roller 13 with respect to the moving direction of the transfer belt 11, and is located between the bias roller 14 and the conductive driven roller 13 at a predetermined interval. In addition a first feedback roller 15 is held in contact with the inner surface of the transfer belt 11. As the transfer belt 11 is moved in a direction for transferring the transfer sheet 19, the first feedback roller 15 is rotated around an axis in the direction indicated by the arrow in the figure.

In this embodiment, a second feedback roller 16 made of metal is provided as a transfer current feedback member. The second feedback roller 16 is located downstream of the bias roller 14 with respect to the moving direction of the transfer belt 11 and is located between the bias roller 14 and the drive roller 12 at a predetermined interval. The second feedback roller 16 is held in contact with the inner surface of the transfer belt 11. As the transfer belt 11 is moved in a direction for transferring the transfer sheet 19, the second feedback roller 16 is rotated around an axis in the direction indicated by the arrow in the figure.

The drive roller 12 is driven by a rotational force of a drive device, not shown, in the direction indicated by the arrow in the figure, with an outer surface of the drive roller 12 held in contact with the inner surface of the transfer belt 11. Both the outer surface of the drive roller 12 and the inner surface of the transfer belt 11 are made of rubber. A power source device 17 is connected to the bias roller 14, the first feedback roller 15, and the second feedback roller 16. The power source device 17 applies a voltage to the bias roller 14 from a power source and controls an output of the power source by a current control circuit or board 17*c*.

Assume that an output current flowing from the power source to the transfer belt 11 via the bias roller 14 is I-1, and that a feedback current flowing from the transfer belt 11 to the power source device 17 via the first feedback roller 15 and the second feedback roller 16 is I-2.

The output current from the power source is controlled so as to satisfy a following equation:

$$I\text{-}1\text{-}I\text{-}2=K$$

where K is constant.

As a result, current flowing from the transfer belt 11 to the photosensitive drum 18 remains constant, and the toner image can be more reliably transferred to the transfer sheet 19 under a stable transfer condition.

In this arrangement, the first feedback roller 15 and the second feedback roller 16 are held in contact with the transfer belt 11 in two contacting positions. In addition, the residual charge on the transfer belt 11 at a location of the drive roller 12 is substantially zero. Thus, the adhering force by which the transfer sheet 19 is adhered onto the transfer belt 11 disappears and the transfer sheet 19 is easily separated from the transfer belt 11 at the location of the drive roller 12.

The current control board of the power source device 17 has a subtractor device and a current control device. The subtractor subtracts the output current I-1 flowing from the power source to the transfer belt 11 via the bias roller 14 from the feedback current I-2 flowing from the transfer belt 11 to the power source device 17 via the first feedback roller 15 and the second feedback roller 16.

The current control device controls the output current I-1 (flowing from the power source to the bias roller 14) such that K remains constant in the equation "I–1–I–2 =K", which is obtained from a result calculated by the subtractor.

The transfer sheet 19 is delivered from a paper feeding device, not shown, and the transfer sheet 19 is polarized by charging, in which a charge is applied from the bias roller 14 via the transfer belt 11. An electrostatic charge is generated on the basis of the relationship between a net charge on the transfer belt 11 and a polarized charge on the transfer sheet 19. The transfer sheet 19 is thus adhered onto the transfer belt 11 by the electrostatic charge.

The toner image is transferred from the photosensitive drum 18 to the transfer sheet 19 at the nip portion between the photosensitive drum 18 and the transfer belt 11. The transfer sheet 19 on which the toner image is then formed is delivered by the transfer belt 11. While the transfer sheet 19 is being delivered, the amount of the charge on the transfer sheet 19 gradually decreases by the transfer belt 11 with the medium electrical resistance, the first feedback roller 15, and the second feedback roller 16.

After a decrease in the amount of charge on the transfer sheet 19, the transfer sheet 19 is weakly adhered onto the transfer belt 11 by the electrostatic charge and the transfer sheet 19 is separated at the location of the drive roller 12 by the rigidity of the transfer sheet 19.

Since the first feedback roller 15 is located upstream of the conductive driven roller 13 with respect to the moving direction of the transfer belt 11, and is located between (in the horizontal direction) the bias roller 14 and the conductive driven roller 13 at a predetermined interval, a surface potential of the transfer belt 11 at the location of the first feedback roller 15 is substantially zero and a surface potential of the transfer belt 11 at the location of the bias roller 14 is a maximum. Thus, a surface potential inclination of the transfer belt 11 is formed. In addition, the surface potential of the conductive driven roller 13 is lowered.

Thus, with the image transferring device of this embodiment, the toner image is not transferred from the photosensitive drum 18 to the transfer sheet 19 upstream of the nip portion with respect to the moving direction of the transfer sheet, and thus pre-transferring of toner is prevented.

The image transferring device can thus improve the quality of the image on the transfer sheet 19. Further, as with the preceding embodiment, since the drive roller 12 has the layer which is made of a non-conductive rubber, the image transferring device can reduce the production cost of the transfer device.

Third Embodiment

Figure 4:
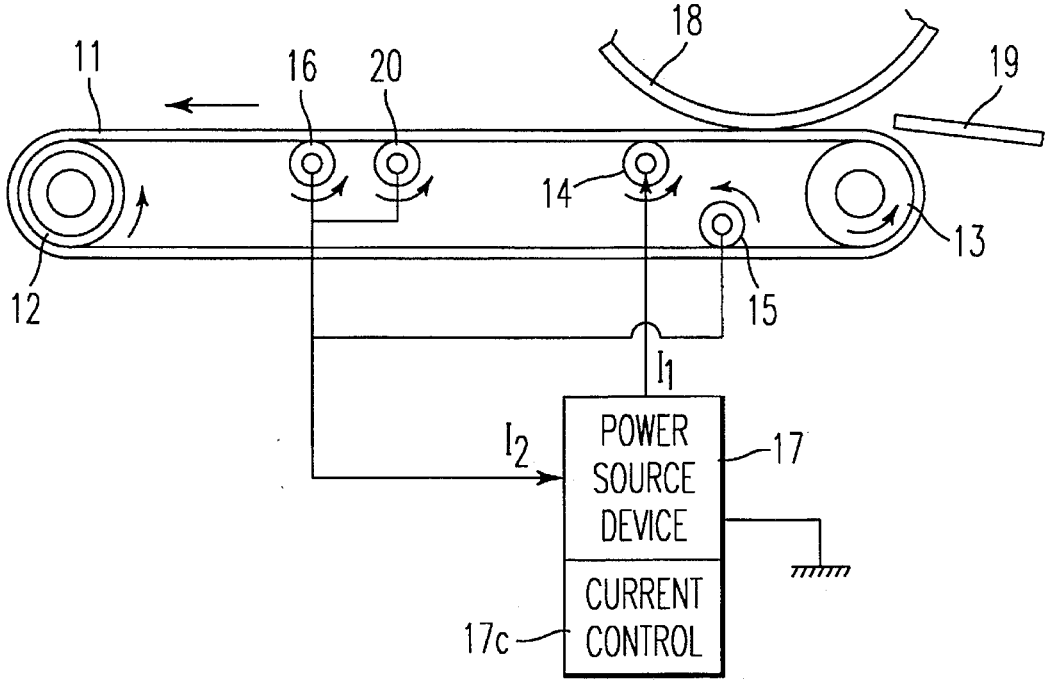
FIG. 4 is a side view showing the construction of a third embodiment of the image transferring device for the image forming apparatus in accordance with the present invention.

FIG. 4 is a section showing a general construction of a third embodiment of an image transferring device for an image forming apparatus in accordance with the present invention. Since many of the elements are the same as the preceding embodiments, a complete description of the common elements is omitted.

As in the second embodiment, the image transferring device has a transfer belt 11, a drive roller 12, a conductive driven roller 13, a bias roller 14, a first feedback roller 15, and a second feedback roller 16. However, in this embodiment a third feedback roller 20 is additionally provided.

The first feedback roller 15 is made of metal as a transfer current feedback member, and is located upstream of the conductive driven roller 13 with respect to the moving direction of the transfer belt 11, and is located between the bias roller 14 and the conductive driven roller 13 at a predetermined interval.

The second feedback roller 16 is also made of metal to act as a transfer current feedback member. In addition, the second feedback roller 16 is located downstream of the third feedback roller 20 with respect to the moving direction of the transfer belt 11 and is located between the third feedback roller 20 and the drive roller 12 at a predetermined interval.

The third feedback roller 20 is also made of metal as a transfer current feedback member. The third feedback roller 20 is held in contact with the belt 11 and located downstream of the bias roller 14 with respect to the moving direction of the transfer belt 11 and is located between the bias roller 14 and the second feedback 16 at a predetermined interval. As the transfer belt 11 is moved in a direction for transferring the transfer sheet 19, the third feedback roller 20 is rotated around an axis in the direction indicated by the arrow in the figure.

A power source device 17 is connected to the bias roller 14, the first feedback roller 15, the second feedback roller 16, and the third feedback roller 20. The power source device 17 applies a voltage to the bias roller 14 from a power source and controls an output of the power source in a current control board 17*c*.

Assume that an output current flowing from the power source to the transfer belt 11 via the bias roller 14 is I-1, and that a feedback current flowing from the transfer belt 11 to the power source device 17 via the first feedback roller 15, the second feedback roller 16 and the third feedback roller 20 is I-2. The output current from the power source is controlled so as to satisfy the following equation:

$$I\text{-}1-I\text{-}2=K$$

where K is constant.

A current flowing from the transfer belt 11 to the photosensitive drum 18 remains constant. The toner image can therefore be more reliably transferred to the transfer sheet 19 under a stable transfer condition.

The first feedback roller 15, the second feedback roller 16 and the third feedback roller 20 are held in contact with the transfer belt 11 in three contacting positions. As a result, the residual charge on the transfer belt 11 at a location of the drive roller 12 is substantially zero. Thus, the adhering force by which the transfer sheet 19 is adhered onto the transfer belt 11 disappears, and the transfer sheet 19 is easily separated from the transfer belt 11 at the location of the drive roller 12.

As in the earlier embodiments, the current control of the power source device 17 has a subtractor device and a current control. The subtractor subtracts the output current I-1 flowing from the power source to the transfer belt 11 via the bias roller 14 from the feedback current I-2 flowing from the transfer belt 11 to the power source device 17 via the first feedback roller 15, the second feedback roller 16, and the third feedback roller 20. The current control controls the output current I-1 flown from the power source to the bias roller 14 such that K remains constant in the equation "I–1–I–2=K" which is obtained from a result calculated by the subtractor means.

The transfer sheet 19 is delivered from a paper feeding device, not shown, and the transfer sheet 19 is polarized by charging, in which a charge is applied from the bias roller 14 via the transfer belt 11. An electrostatic charge is generated on the basis of the relationship between a net charge on the transfer belt 11 and a polarized charge on the transfer sheet 19. The transfer sheet 19 is adhered onto the transfer belt 11 by the electrostatic charge. The toner image is transferred from the photosensitive drum 18 to the transfer sheet 19 at the nip portion which is formed by the photosensitive drum 18 and the transfer belt 11.

While the transfer sheet 19 is being delivered, the amount of charge on the transfer sheet 19 is gradually decreased by the transfer belt 11 with the medium or moderate electrical resistance, the first feedback roller 15, the second feedback roller 16, and the third feedback roller 20. After a decrease in the amount of the charge on the transfer sheet 19, the transfer sheet 19 is weakly adhered onto the transfer belt 11 by the electrostatic charge and thus is separated at the location of the drive roller 12.

As the first feedback roller 15 is located upstream of the conductive driven roller 13 with respect to the moving direction of the transfer belt 11 and is located between the bias roller 14 and the conductive driven roller 13 at a predetermined interval, a surface potential of the transfer belt 11 at a location of the first feedback roller 15 is substantially zero and a surface potential of the transfer belt 11 at a location of the bias roller 14 is a maximum. A surface potential inclination of the transfer belt 11 is thus formed with this arrangement as described above.

As in the embodiments previously discussed, with this embodiment a surface potential of the conductive driven roller 13 is lowered, and the toner image is not transferred from the photosensitive drum 18 to the transfer sheet 19 upstream of the nip portion. Thus, the image transferring device can improve the quality of the image on the transfer sheet 19, while also being satisfactory from a production cost standpoint.

Fourth Embodiment

Figure 5:
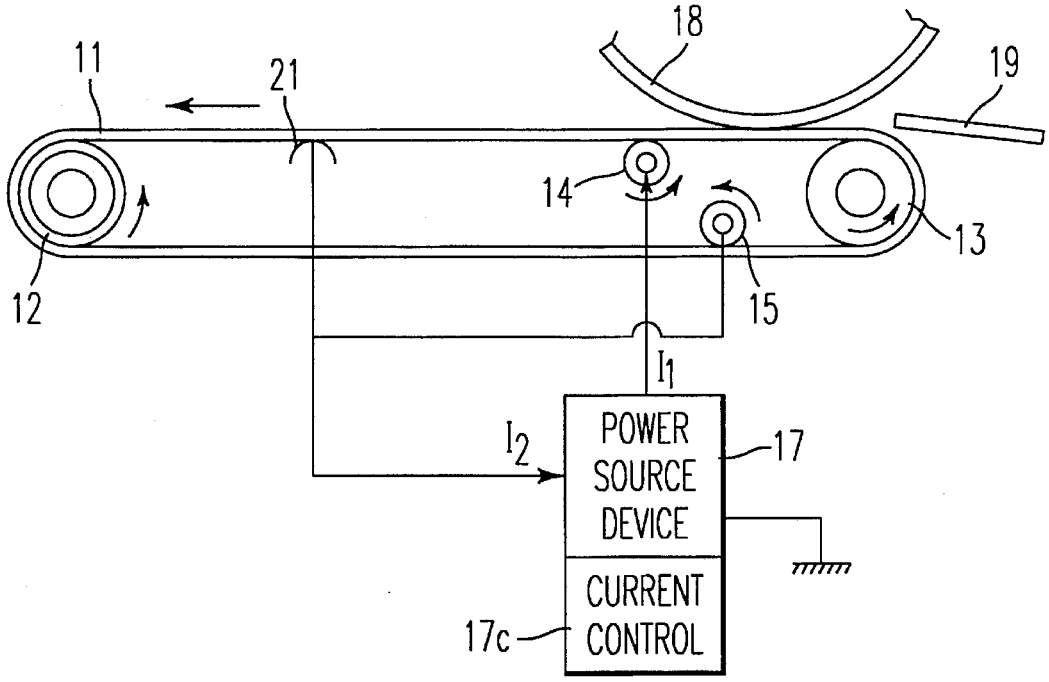
FIG. 5 is a side view showing the construction of a fourth embodiment of the image transferring device for the image forming apparatus in accordance with the present invention.

FIG. 5 is a section showing the construction of a fourth embodiment of an image transferring device for an image forming apparatus in accordance with the present invention in which elements corresponding to the previous embodiments are designated with like reference numerals.

The image transferring device has a transfer belt 11, a drive roller 12, a conductive driven roller 13, a bias roller 14, a metal feedback roller 15, and a power source 17. In this embodiment, a contact plate is also provided as shown at 21.

The feedback roller 15 is made of metal as a transfer current feedback member, and is located upstream of the conductive driven roller 13 with respect to the moving direction of the transfer belt 11, between the bias roller 14 and the conductive driven roller 13 at a predetermined interval. The contact plate 21 is made of metal as a transfer current feedback member. The contact plate 21 is located downstream of the bias roller 14 with respect to the moving direction of the transfer belt 11, and between the bias roller 14 and the drive roller 12 at a predetermined interval. The contact plate 21 is held in contact with the inner surface of the transfer belt 11.

A power source device 17 is connected to the bias roller 14, the feedback roller 15, and the contact plate 21. The power source device 17 applies a voltage to the bias roller 14 from a power source and controls an output of the power source in a current control board.

Assume that an output current flowing from the power source to the transfer belt 11 via the bias roller 14 is I-1, and that a feedback current flowing from the transfer belt 11 to the power source device 17 via the feedback roller 15 and the contact plate 21 is I-2. The output current from the power source is controlled so as to satisfy a following equation:

$$I\text{-}1\text{-}I\text{-}2=K$$

where K is constant.

A current flowing from the transfer belt 11 to the photosensitive drum 18 remains constant. The toner image can thus be reliably transferred to the transfer sheet 19 under a stable transfer condition.

The feedback roller 15 and the contact plate 21 are held in contact with the transfer belt 11 in two contacting positions, and a residual charge on the transfer belt 11 at a location of the drive roller 12 is substantially zero. Thus, the transfer sheet 19 is easily separated from the transfer belt 11 at the location of the drive roller 12.

As in the preceding embodiments, the current control board or circuit of the power source device 17 includes a subtractor device and a current control device. The subtractor subtracts the output current I-1 flowing from the power source to the transfer belt 11 via the bias roller 14 from the feedback current I-2 flowing from the transfer belt 11 to the power source device 17 via the feedback roller 15 and the contact plate 21. The current control device controls the output current I-1 flowing from the power source to the bias roller 14 such that K remains constant in the equation "I–1–I–2=K" which is obtained from a result calculated by the subtractor.

In operation, the transfer sheet 19 is delivered from a paper feeding device, not shown. The transfer sheet 19 is polarized by charging, in which a charge is applied from the bias roller 14 via the transfer belt 11. An electrostatic charge is generated on the basis of the relationship between a net charge on the transfer belt 11 and a polarized charge on the transfer sheet 19. The transfer sheet 19 is adhered onto the transfer belt 11 by the electrostatic charge. The toner image is transferred from the photosensitive drum 18 to the transfer sheet 19 at the nip portion between the photosensitive drum 18 and the transfer belt 11.

While the transfer sheet 19 is being delivered, the amount of charge on the transfer sheet 19 gradually decreases by the transfer belt 11 with the medium electrical resistance, the feedback roller 15, and the contact plate 21. After a decrease in the amount of the charge on the transfer sheet 19, the transfer sheet 19 is weakly adhered onto the transfer belt 11 by the electrostatic charge, and the transfer sheet 19 is separated at the location of the drive roller 12.

Since the feedback roller 15 is located upstream of the conductive driven roller 13 with respect to the moving direction of the transfer belt 11 and is located (horizontally) between the bias roller 14 and the conductive driven roller 13 at a predetermined interval, a surface potential of the transfer belt 11 at a location of the feedback roller 15 is substantially zero and a surface potential of the transfer belt 11 at a location of the bias roller 14 is a maximum. A surface potential inclination of the transfer belt 11 is thus formed. Therefore, a surface potential of the conductive driven roller 13 is lowered.

In the image transferring device, the toner image is prevented from being transferred from the photosensitive drum 18 to the transfer sheet 19 upstream of the nip portion with respect to the moving direction of the transfer belt so as to prevent pre-transferring of toner.

The image transferring device of this embodiment thus also improves the quality of the image on the transfer sheet 19, while maintaining a relatively low cost by utilizing a non-conductive rubber layer for drive roller 12.

Fifth Embodiment

Figure 6:
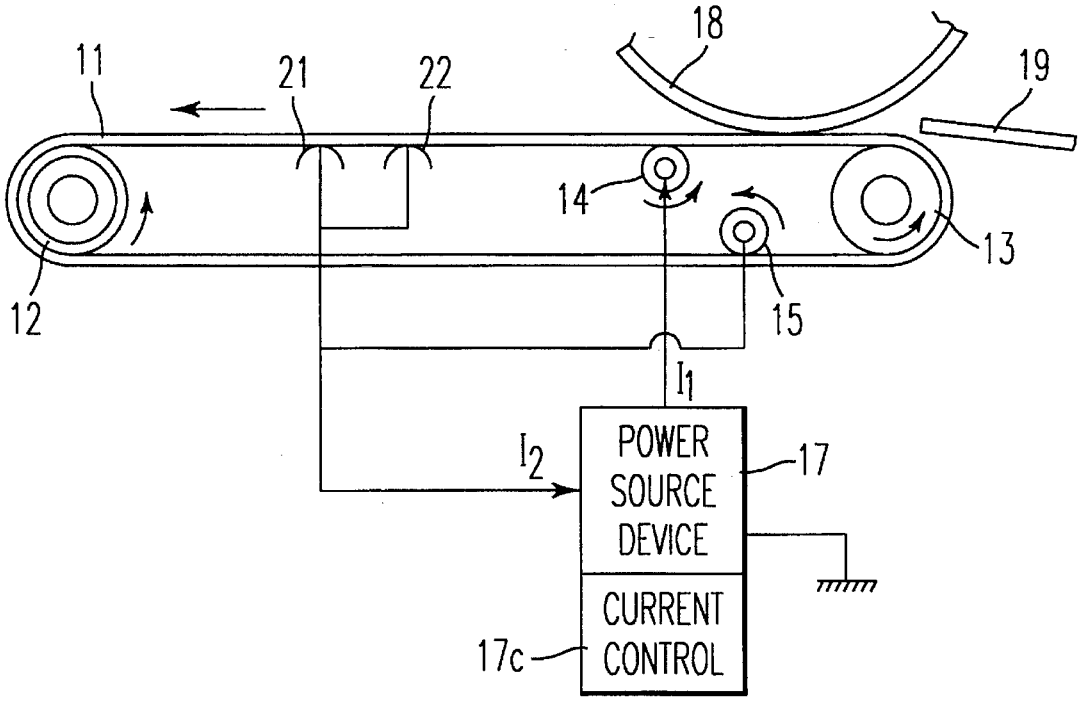
FIG. 6 is a side view showing the construction of a fifth embodiment of the image transferring device for the image forming apparatus in accordance with the present invention.

FIG. 6 is a section showing the construction of a fifth embodiment of an image transferring device for an image forming apparatus in accordance with the present invention, with like elements of previous embodiments designated by like numerals.

This embodiment has a transfer belt 11, a drive roller 12, a conductive driven roller 13, a bias roller 14, a feedback roller 15, a first contact plate 21, a second contact plate 22, and a power source 17.

The first contact plate 21 and second contact plate 22 are made of metal to act as a transfer current feedback members. The first contact plate 21 is located downstream of the second contact plate 22 with respect to the moving direction of the transfer belt 11 and is located between the second contact plate 22 and the drive roller 12 at a predetermined interval. The second contact plate 22 is located downstream of the bias roller 14 with respect to the moving direction of the transfer belt 11 and is located between the bias roller 14 and the first contact plate 21 at a predetermined interval. In addition, the second contact plate 22 is held in contact with the inner surface of the transfer belt 11.

A power source device 17 is connected to the bias roller 14, the feedback roller 15, the first contact plate 21, and the second contact plate 22. The power source device 17 applies voltage to the bias roller 14 from a power source and controls an output of the power source in a current control board 17*c*.

Assume that an output current flowing from the power source to the transfer belt 11 via the bias roller 14 is I-1, and that a feedback current flowing from the transfer belt 11 to the power source device 17 via the feedback roller 15, the first contact plate 21, and the second contact plate 22.

The output current from the power source is controlled so as to satisfy a following equation:

$$I\text{-}1\text{-}I\text{-}2=K$$

where K is constant.

As a result, current flowing from the transfer belt 11 to the photosensitive drum 18 remains constant, and the toner image can be more reliably transferred to the transfer sheet 19 under a stable transfer condition.

In this embodiment, the feedback roller 15, the first contact plate 21, and the second contact plate 22 are held in contact with the transfer belt 11 in three contacting positions. A residual charge on the transfer belt 11 at a location of the drive roller 12 is substantially zero, and the transfer sheet 19 is easily separated from the transfer belt 11 at the location of the drive roller 12.

The current control board or circuitry of the power source device 17 has a subtractor and a current control. The subtractor subtracts the output current I-1 flowing from the power source to the transfer belt 11 via the bias roller 14 from the feedback current I-2 flowing from the transfer belt 11 to the power source device 17 via the feedback roller 15, the first contact plate 21, and the second contact plate 22.

The current control controls the output current I-1 flowing from the power source to the bias roller 14 such that K remains constant in the equation "I–1–I–2=K", which is obtained from a result calculated by the subtractor means.

In the operation, the transfer sheet 19 is delivered from a paper feeding device, not shown. The transfer sheet 19 is polarized by charging, in which a charge is applied from the bias roller 14 via the transfer belt 11. An electrostatic charge is generated on the basis of the relationship between a net charge on the transfer belt 11 and a polarized charge on the transfer sheet 19. The transfer sheet 19 is adhered to the transfer belt 11 by the electrostatic charge. The toner image is transferred from the photosensitive drum 18 to the transfer sheet 19 at the nip portion between the photosensitive drum 18 and the transfer belt 11. The transfer sheet 19 on which the toner image is formed is delivered by the transfer belt 11.

While the transfer sheet 19 is being delivered, the amount of charge on the transfer sheet 19 gradually decreases by the transfer belt 11 with the medium electrical resistance, the feedback roller 15, the first contact plate 21, and the second contact plate 22. After a decrease in the amount of the charge on the transfer sheet 19, the transfer sheet 19 is separated at the location of the drive roller 12.

As in the previous embodiments, the feedback roller 15 is located upstream of the conductive driven roller 13 with respect to the moving direction of the transfer belt 11 and is located between the bias roller 14 and the conductive driven roller 13 at a predetermined interval. As a result, the surface potential of the transfer belt 11 at a location of the feedback roller 15 is substantially zero and a surface potential of the transfer belt 11 at a location of the bias roller 14 is a maximum. A surface potential inclination of the transfer belt 11 is thus formed, and a surface potential of the conductive driven roller 13 is lowered. Accordingly, as with the previous embodiments, the toner image is not transferred from the photosensitive drum 18 to the transfer sheet 19 upstream of the nip portion and pre-transferring of toner is prevented. In addition, expensive conductive rubber rollers are not needed, since the drive roller 12 can be formed with a non-conductive rubber outer surface.

Sixth Embodiment

Figure 7:
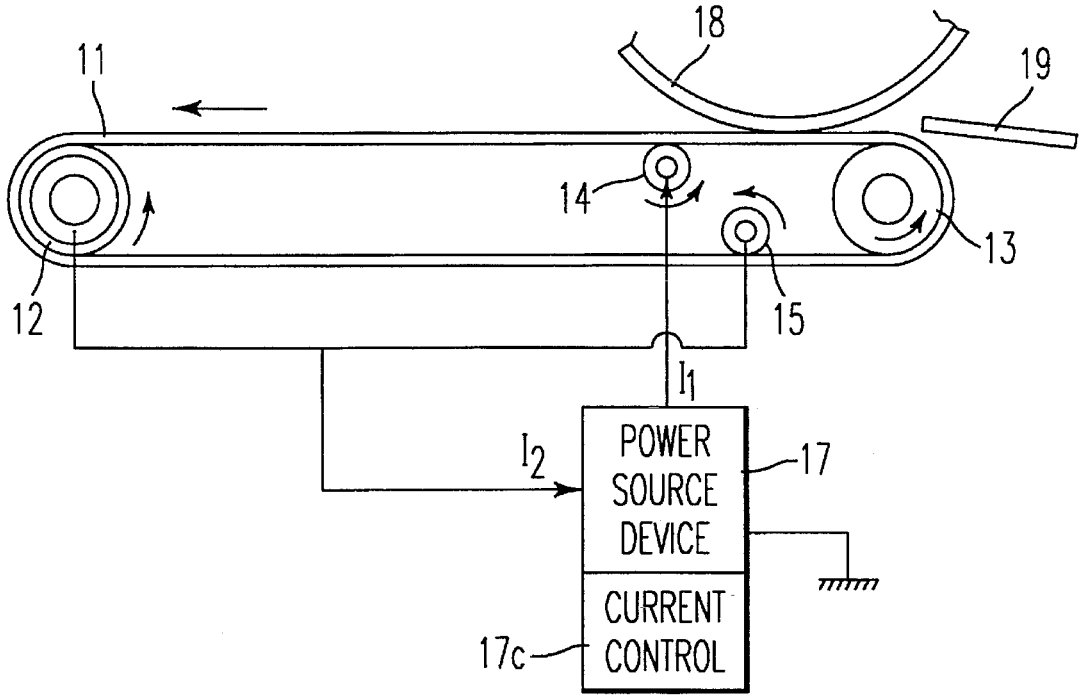
FIG. 7 is a side view showing the construction of sixth embodiment of the image transferring device for the image forming apparatus in accordance with the present invention.
Figure 8:
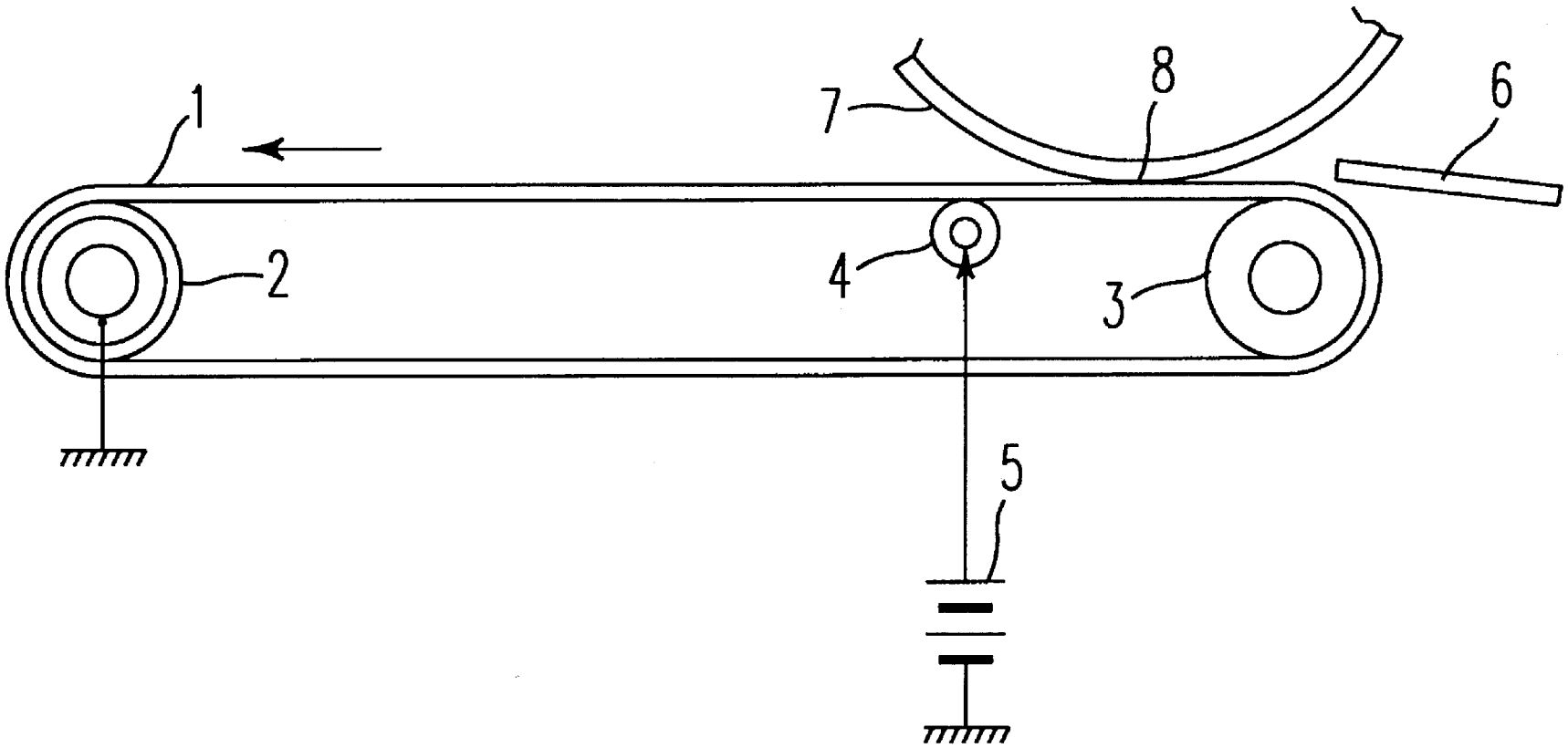
FIG. 8 PRIOR ART
FIG. 8 is a side view showing the construction of a conventional image transferring device for an image forming apparatus.

FIG. 7 is a side view showing the construction of a sixth embodiment of an image transferring device for an image forming apparatus in accordance with the present invention. In this embodiment, the roller 12 is connected to the power source 17. The image transferring device has a transfer belt 11 (of a medium or moderate electrical resistance as discussed earlier), a conductive drive roller 12, a conductive driven roller 13, a bias roller 14, a feedback roller 15, and a power source 17.

The conductive drive roller 12 has a metallic core and a conductive layer covering the metallic core. The conductive layer is made of a conductive rubber. The conductive driven roller 13 is made of metal. The conductive drive roller 12 is connected to a motor, not shown, and is rotated around an axis in a direction indicated by an arrow in the figure. As the conductive drive roller 12 is rotated, the transfer belt 11 is moved in a direction for transferring a transfer sheet 19 (indicated by the arrow in the figure). As the conductive drive roller 12 is rotated, the conductive driven roller 13 is also rotated around an axis in the direction indicated by the arrow in the figure.

The power source device 17 is connected to the bias roller 14, the feedback roller 15, and the conductive drive roller 12. The power source device 17 applies a voltage to the bias roller 14 from a power source and controls an output of the power source in a current control board 17*c*.

Assume that an output current flowing from the power source to the transfer belt 11 via the bias roller 14 is I-1, and that a feedback current flowing from the transfer belt 11 to the power source device 17 via the conductive drive roller 12 and the feedback roller 15 is I-2.

The output current from the power source is controlled so as to satisfy a following equation:

$$I\text{–}1\text{–}I\text{–}2=\mathrm{K}$$

where K is constant. A current flowing from the transfer belt 11 to the photosensitive drum 18 thus remains constant. The toner image can thus reliably be transferred to the transfer sheet 19 under a stable transfer condition.

The conductive drive roller 12 and the feedback roller 15 are held in contact with the transfer belt 11 in two contacting positions. A residual charge on the transfer belt 11 at a location of the conductive drive roller 12 is thus substantially zero, and an adhering force by which the transfer sheet 19 is adhered onto the transfer belt 11 disappears to allow separation of the sheet.

As in the preceding embodiments, the subtractor subtracts the output current I-1 flowing from the power source to the transfer belt 11 via the bias roller 14 from the feedback current I-2 flowing from the transfer belt 11 to the power source device 17 via the conductive drive roller 12 and the feedback roller 15.

The current control controls the output current I-1 flowing from the power source to the bias roller 14 such that K remains constant in the equation "I–1–I–2=K", which is obtained from a result calculated by the subtractor. In operation, the transfer sheet 19 is delivered from a paper feeding device, not shown. The transfer sheet 19 is polarized by charging, in which a charge is applied from the bias roller 14 via the transfer belt 11.

An electrostatic charge is generated on the basis of the relation between a net charge on the transfer belt 11 and a polarized charge on the transfer sheet 19. The transfer sheet 19 is adhered onto the transfer belt 11 by the electrostatic charge. The toner image is transferred from the photosensitive drum 18 to the transfer sheet 19 at the nip portion between the photosensitive drum 18 and the transfer belt 11. The transfer sheet 19 on which the toner image is thus formed is delivered by the transfer belt 11. While the transfer sheet 19 is being delivered, the amount of charge on the transfer sheet 19 is gradually decreased by the transfer belt 11 with the medium electric resistance, the conductive drive roller 12, and the feedback roller 15.

Since the feedback roller 15 is located upstream of the conductive driven roller 13 with respect to the moving direction of the transfer belt 11 and is located between the bias roller 14 and the conductive driven roller 13 at a predetermined interval, a surface potential of the transfer belt 11 at the location of the feedback roller 15 is substantially zero and a surface potential of the transfer belt 11 at a location of the bias roller 14 is a maximum. A surface potential inclination of the transfer belt 11 is thus formed.

As with the other embodiments, in the FIG. 7 arrangement a surface potential of the conductive driven roller 13 is lowered. In the image transferring device, the toner image is not transferred from the photosensitive drum 18 to the transfer sheet 19 upstream of the nip portion with respect to the moving direction of the transfer belt so as to prevent pre-transferring of toner.

The image transferring device can thus improve the quality of the image on the transfer sheet 19.

As should be apparent, various modifications are possible for those skilled in the art in view of the teachings of the present disclosure. It is therefore to be understood that within the scope of the present claims, the invention may be practiced otherwise than as specifically described herein.

What is claimed is as new and is desired to be secured by Letters Patent of the United States is:

1. A device incorporated in an image forming apparatus for transferring an image from a photosensitive element to a transfer sheet, comprising:

a first supporting member;

a second supporting member;

a transfer belt for transferring a toner image formed on a latent image carrier to a transfer sheet, said transfer belt passing over said first supporting member and said second supporting member;

a bias member;

a feedback member;

a power source for applying a voltage to said bias member, and including means for controlling an output of said power source, said power source being connected to said bias member and said feedback member;

wherein an output current flowing from said power source to said transfer belt via said bias member is I-1;

wherein I-1 and I-2 satisfy the following equation:

$$I\text{-}1-I\text{-}2=K$$

where K is constant;

wherein said transfer belt includes a run for transferring said transfer sheet extending between said first supporting member and said second supporting member, and a run which does not transfer said transfer sheet extending between said first supporting member and said second supporting member, and further wherein said bias member contacts said transfer belt along said run for transferring said transfer sheet and only said feedback member contacts said transfer belt along said run which does not transfer said transfer sheet, and wherein said bias member is located downstream of a nip portion between said photosensitive element and said transfer belt with respect to a moving direction of said transfer belt, and further wherein the feedback current flowing from said transfer belt to said power source via said feedback member and said first supporting member is I-2.

2. A device incorporated in an image forming apparatus for transferring an image from a photosensitive element to a transfer sheet, comprising:

a first supporting member;

a second supporting member;

a transfer belt for transferring a toner image formed on a latent image carrier to a transfer sheet, said transfer belt passing over said first supporting member and said second supporting member;

a bias member;

a feedback member;

a power source for applying a voltage to said bias member, and including means for controlling an output of said power source, said power source being connected to said bias member and said feedback member;

wherein an output current flowing from said power source to said transfer belt via said bias member is I-1, and a feedback current flowing from said transfer belt to said power source via said feedback member is I-2;

wherein I-1 and I-2 satisfy the following equation:

$$I\text{-}1-I\text{-}2=K$$

where K is constant;

wherein said feedback member is located upstream of said second supporting member with respect to a moving direction of said transfer belt, and is located between said bias member and said second supporting member at a predetermined interval;

wherein said transfer belt includes a run for transferring said transfer sheet extending between said first supporting member and said second supporting member, and a run which does not transfer said transfer sheet extending between said first supporting member and said second supporting member, and further wherein said bias member contacts said transfer belt along said run for transferring said transfer sheet and said feedback member contacts said transfer belt along said run which does not transfer said transfer sheet; and said feedback member is disposed, with respect to a horizontal direction, between said bias member and said second supporting member.

3. The device of claim 2, wherein the feedback current flowing from said transfer belt to said power source via said feedback member and said first supporting member is I-2.

4. The device of claim 2, wherein said bias member is located downstream of a nip portion between said photosensitive element and said transfer belt with respect to a moving direction of said transfer belt.

* * * * *